US005518472A

United States Patent [19]

Chen

[11] Patent Number: 5,518,472

[45] Date of Patent: May 21, 1996

[54] SWIMMING EXERCISER

[76] Inventor: Paul Chen, 5th Floor, No. 31, Gan Tzou 2nd St., Shi Tun Chu, Taichung, Taiwan

[21] Appl. No.: 489,378

[22] Filed: Jun. 12, 1995

[51] Int. Cl.[6] ..... A63B 69/10

[52] U.S. Cl. ..... 482/56; 482/96; 482/142

[58] Field of Search ..... 482/55, 56, 142, 482/95, 96

[56] References Cited

U.S. PATENT DOCUMENTS 3,976,058 8/1976 Tidwell ..... 482/56

FOREIGN PATENT DOCUMENTS 1261678 10/1986 U.S.S.R. ..... 482/56

1395343 5/1988 U.S.S.R. ..... 482/56

*Primary Examiner*—Lynne A. Reichard

*Attorney, Agent, or Firm*—Charles E. Baxley

[57] ABSTRACT

An exerciser includes a post and a rod having a lower portion pivotally coupled to a base. A board is secured on top of the post for supporting users. A slide is slidably engaged on the board and movable longitudinally along the board. The slide is pivotally coupled to the upper portion of the rod. Two handles are pivotally coupled to the front portion of the board and are pivotally coupled to the slide for moving the slide longitudinally along the board when the handles are rotated such that the users may simulate swimming type exercises.

6 Claims, 3 Drawing Sheets

SWIMMING EXERCISER

BACKGROUND OF THE INVENTION

1. Field of the Invention

The present invention relates to an exerciser, and more particularly to a swimming type exerciser.

2. Description of the Prior Art

Various kinds of exercisers have been developed for simulating jogging, horse-riding, rowing, bicycle riding, weight elevating exercises etc. However, no exercisers are provided for simulating swimming exercises.

The present invention has arisen to mitigate and/or obviate the afore-described disadvantages of the conventional exercisers.

SUMMARY OF THE INVENTION

The primary objective of the present invention is to provide a swimming type exerciser for simulating swimming exercises.

In accordance with one aspect of the invention, there is provided an exerciser comprising a base including a front portion having a pivot pin provided therein and including a rear portion having a pivot axis provided therein, a post including a lower portion pivotally coupled to the base at the pivot axis and including an upper portion, a rod including a lower portion pivotally coupled to the base at the pivot pin and including an upper portion, a board secured on the upper portion of the post for supporting users thereon and rotatable about the pivot axis, the board including a front portion and a rear portion, a slide means slidably engaged on the board and movable longitudinally along the board, the slide being pivotally coupled to the upper portion of the rod, and means for moving the slide means along the board so as to rotate the rod about the pivot pin and so as to elevate the board.

The moving means includes two couplers pivotally coupled to the front portion of the board at two pivot axles, two handles pivotally coupled to the couplers, and link means pivotally coupling the handles to the slide for moving the slide longitudinally along the board when the handles are rotated.

The link means includes two bars secured to the pivot axles so as to be rotated by the handles, and two links pivotally coupling the bars to the slide so as to move the slide along the board when the handles are rotated.

The front portion of the board includes two resilient studs secured thereon engaging with shoulders of the users.

Two beams are pivotally coupled to the rear portion of the board at two pivot shafts, and two lever means are pivotally coupling the slide to the beams for rotating the beams when the slide moves along the board.

The lever means includes two extensions extended from the beams and rotatable about the pivot shafts, and two levers pivotally coupling the extensions to the slide so as to rotate the extensions and the beams when the slide moves along the board and when the handles are rotated.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
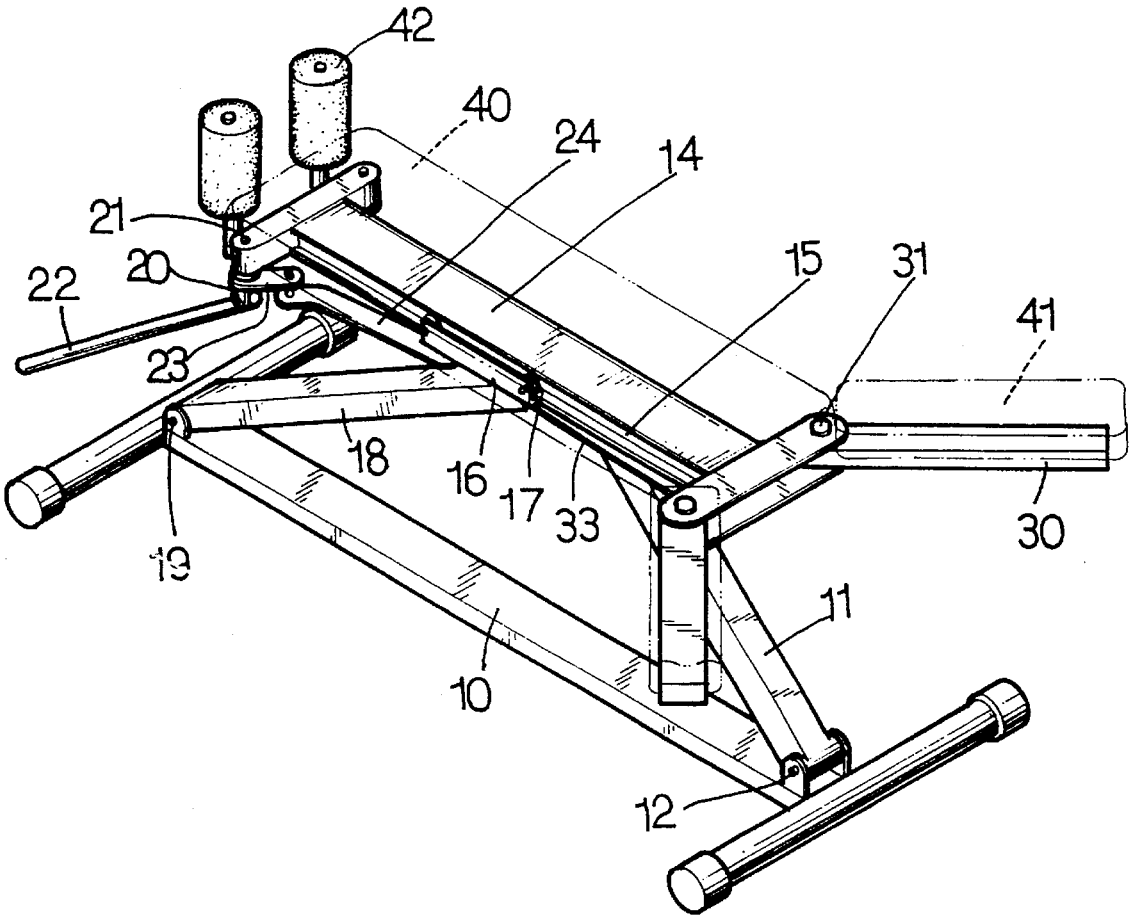
FIG. 1 is a perspective view of a swimming type exerciser in accordance with the present invention.
Figure 2:
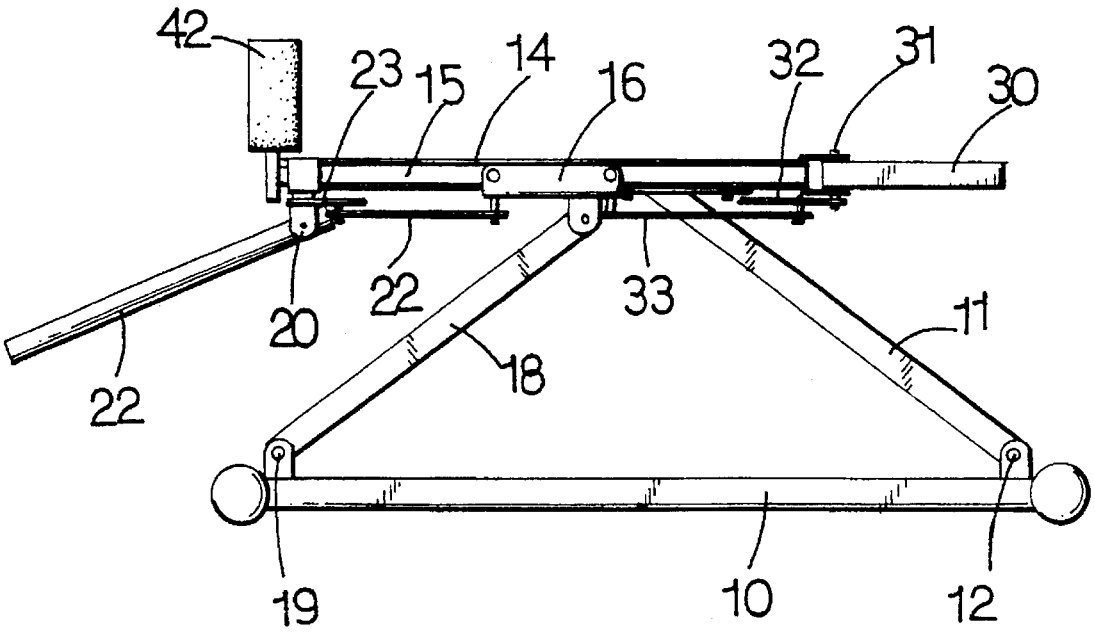
FIGS. 2 and 3 are plane views illustrating the operation of the exerciser.

Referring to the drawings, and initially to FIGS. 1 and 2, a swimming type exerciser in accordance with the present invention comprises a base 10 including a post 11 having a lower portion pivotally coupled to the rear portion at a pivot axis 12 and including a rod 18 having a lower portion pivotally coupled to the front portion at a pivot pin 19. A board 14 is fixed on top of the post 11 and rotatable about the pivot axis 12. A cushion 40 is disposed on the board 14 for supporting the users thereon. The board 14 includes two side portions each having a track means 15 formed therein. A slide 16 is slidably engaged on the board and includes roller means 17 engaged in the track means 15 such that the slide 16 is slidable longitudinally along the board 14. Two resilient studs 42 are secured on the front portion of the board 14 for engaging with the shoulders of the users.

Figure 4:
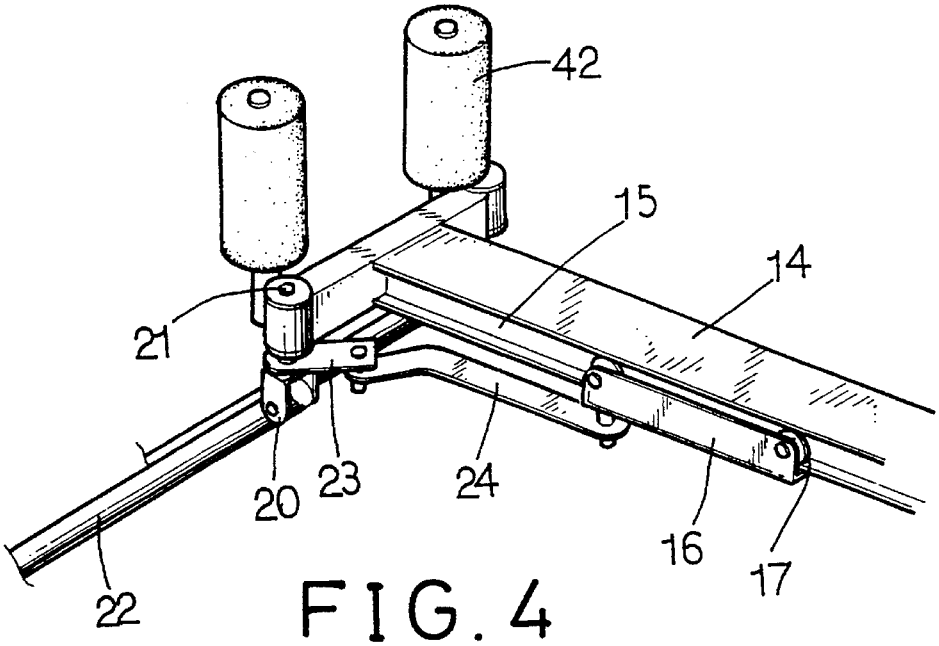
FIG. 4 is an enlarged partial perspective view illustrating the coupling portion of the exerciser.

Two couplers 20 are pivotally coupled to the front portion of the board 14 by two pivot axles 21. Two handles 22 are pivotally coupled to the couplers 20 and two bars 23 are secured to the pivot axles 21 and rotated in concert with the pivot axles 21 such that the bars 23 may be rotated by the handles 22. Two links 24 pivotally couple the slide 16 to the bars 23 such that the slide 16 may be moved longitudinally along the board 14 when the handles 22 are rotated about the pivot axles 21, best shown in FIGS. 4 and 5.

Figure 3:
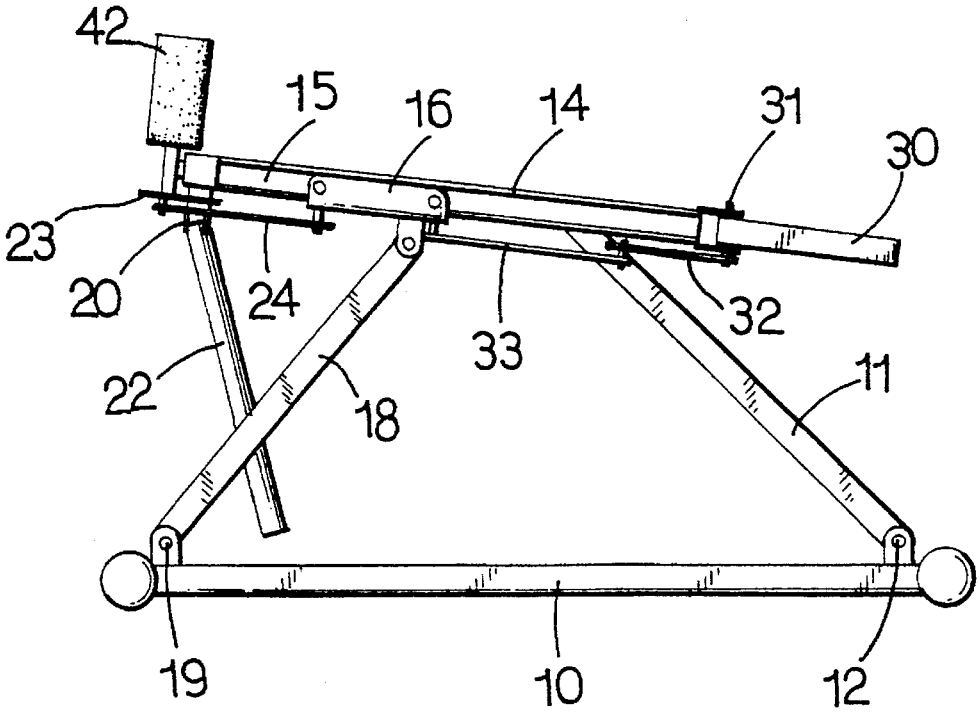

Referring next to FIG. 3 and again to FIG. 2, when the slide 16 is moved forward along the board 14, the rod 18 is caused to rotate about the pivot pin 19 such that the front portion of the board 14 may be forced to move upward against the weight of the users, and such that the users may simulate swimming type exercises.

Referring again to FIGS. 1, 2 and 5, two beams 30 are pivotally coupled to the rear portion of the board 14 at two pivot shafts 31 and have cushions 41 provided thereon for supporting the leg portions of the users. The beams 30 each includes an extension 32 extended therefrom and substantially perpendicular to the beams 30, best shown in FIG. 5. Two levers 33 pivotally couple the extensions 32 to the slide 16 such that the beams 30 may be rotated about the pivot shafts 31 when the slide 16 is moved longitudinally along the board 14.

Figure 5:
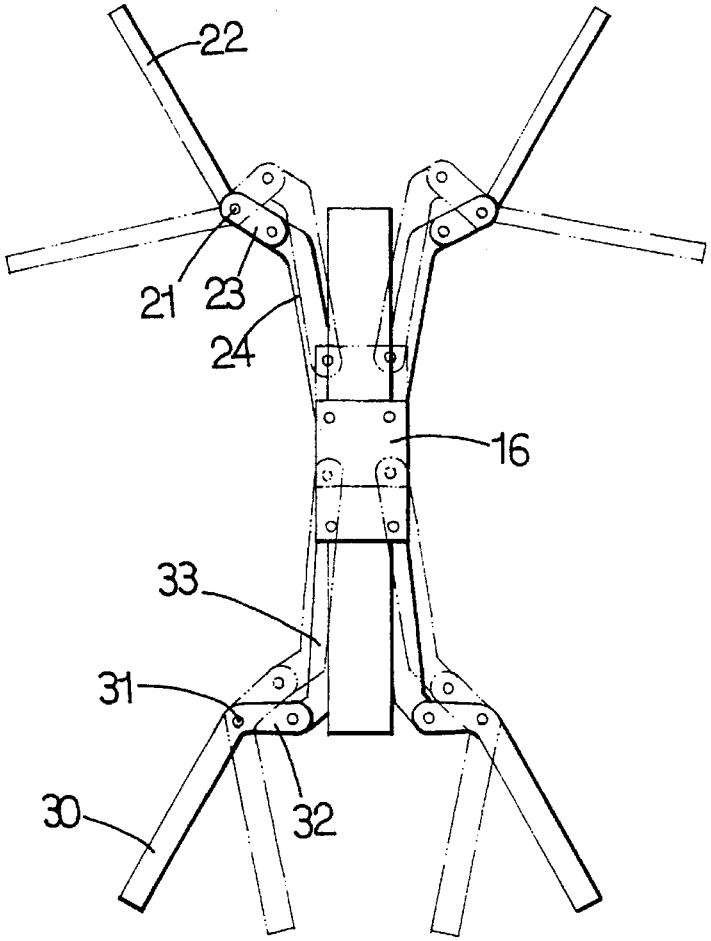
FIG. 5 is a schematic view illustrating the operation of the exerciser.

In operation, as shown in FIG. 5, when the handles 22 are rotated about the pivot axles 21 by the users, the slide 16 may be moved longitudinally along the board 14 such that the board 14 may be elevated by the rod 18 when the rod 18 is rotated about the pivot pin 19. The beams 30 for supporting the legs of the users may also be caused to rotate about the pivot shafts 31 when the slide 16 is moved longitudinally along the board 14.

Alternatively, a number of gears may be secured to the pivot axles 21 and the pivot shafts 31 instead of the bars 23 and the extensions 32; and two racks are secured to the side portions of the slide 16 for engaging with the gears such that the slide 16 may also be moved longitudinally along the board 14 when the handles 22 are rotated, and such that the beams 30 may also be rotated about the pivot shafts 31 when the slide 16 moves longitudinally along the board 14.

Accordingly, the swimming type exerciser in accordance with the present invention includes a pair of handles that may be rotated by the users in order to simulate swimming type exercises, and includes a board that may be elevated against the weight of the users.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An exerciser comprising:

a base including a front portion having a pivot pin provided therein and including a rear portion having a pivot axis provided therein, a post including a lower portion pivotally coupled to said base at said pivot axis and including an upper portion, a rod including a lower portion pivotally coupled to said base at said pivot pin and including an upper portion, a board secured on said upper portion of said post for supporting users thereon and rotatable about said pivot axis, said board including a front portion and a rear portion, a slide means slidably engaged on said board and movable longitudinally along said board, said slide being pivotally coupled to said upper portion of said rod, and means for moving said slide means along said board so as to rotate said rod about said pivot pin and so as to elevate said board.

2. An exerciser according to claim 1, wherein said moving means includes two couplers pivotally coupled to said front portion of said board at two pivot axles, two handles pivotally coupled to said couplers, and link means pivotally coupling said handles to said slide for moving said slide longitudinally along said board when said handles are rotated.

3. An exerciser according to claim 2, wherein said link means includes two bars secured to said pivot axles so as to be rotated by said handles, and two links pivotally coupling said bars to said slide so as to move said slide along said board when said handles are rotated.

4. An exerciser according to claim 1, wherein said front portion of said board includes two resilient studs secured thereon for engaging with shoulders of the users.

5. An exerciser according to claim 1 further comprising two beams pivotally coupled to said rear portion of said board at two pivot shafts, and two lever means pivotally coupling said slide to said beams for rotating said beams when said slide moves along said board.

6. An exerciser according to claim 5, wherein said lever means includes two extensions extended from said beams and rotatable about said pivot shafts, and two levers pivotally coupling said extensions to said slide so as to rotate said extensions and said beams when said slide moves along said board and when said handles are rotated.

* * * * *